US008371577B2

(12) United States Patent
Schoenmakers

(10) Patent No.: US 8,371,577 B2
(45) Date of Patent: Feb. 12, 2013

(54) SHEET STACKING DEVICE

(75) Inventor: Erik J. W. Schoenmakers, Venlo (NL)

(73) Assignee: OCE Technologies B.V., Venlo (NL)

( * ) Notice: Subject to any disclaimer, the term of this patent is extended or adjusted under 35 U.S.C. 154(b) by 0 days.

(21) Appl. No.: 13/460,909

(22) Filed: May 1, 2012

(65) Prior Publication Data

US 2012/0217697 A1 Aug. 30, 2012

Related U.S. Application Data

(63) Continuation of application No. PCT/EP2010/066629, filed on Nov. 2, 2010.

(30) Foreign Application Priority Data

Nov. 6, 2009 (EP) ..... 09175261

(51) Int. Cl.
*B65H 43/00* (2006.01)

(52) U.S. Cl. ..... 271/176; 271/207

(58) Field of Classification Search ..... 271/176, 271/207

See application file for complete search history.

(56) References Cited

U.S. PATENT DOCUMENTS

| | | | | |
|---|---|---|---|---|
| 5,020,786 | A | 6/1991 | Kimura et al. | |
| 5,961,115 | A * | 10/1999 | Blanck et al. | 271/263 |
| 7,717,421 | B2 * | 5/2010 | Rennick et al. | 271/207 |
| 2008/0154426 | A1 | 6/2008 | Kikuchi | |
| 2010/0025924 | A1 * | 2/2010 | Rennick et al. | 271/207 |

FOREIGN PATENT DOCUMENTS

| | | | |
|---|---|---|---|
| DE | 102005011877 | A1 | 9/2006 |
| JP | 58-212548 | A | 12/1983 |
| JP | 2002-326763 | A | 11/2002 |

* cited by examiner

*Primary Examiner* — David H Bollinger
(74) *Attorney, Agent, or Firm* — Birch, Stewart, Kolasch & Birch, LLP

(57) ABSTRACT

A sheet stacking device for a sheet handling system, a method and a computer program product are provided for controlling a sheet stacking device of a sheet handling system. The sheet stacking device includes at least one sheet entrance pathway for receiving incoming sheets and a sheet output unit with at least one output tray for stacking the received sheets to form a at least one stack on the at least one output tray. The sheet stacking device further includes a control unit for determining the weight of the stack on the at least one output tray and for providing a control signal if the determined weight exceeds a predetermined value, and a stack separating mechanism for distinguishing two or more stacks on the same output tray, said stack separating mechanism being controlled by the control unit to limit the weight of the distinguished stacks.

13 Claims, 2 Drawing Sheets

SHEET STACKING DEVICE

CROSS-REFERENCE TO RELATED APPLICATIONS

This application is a Continuation of International Application No. PCT/EP2010/066629, filed on Nov. 2, 2010, and for which priority is claimed under 35 U.S.C. §120, and which claims priority under 35 U.S.C. §119 to Application No. 09175261.8, filed on Nov. 6, 2009. The entirety of each of the above-identified applications is expressly incorporated herein by reference.

BACKGROUND OF THE INVENTION

1. Field of the Invention

The present invention relates to a sheet stacking device for a sheet handling system, comprising at least one sheet entrance pathway for receiving incoming sheets; a sheet output unit with at least one output tray for stacking the received sheets to form at least one stack on the at least one output tray; and a control unit configured to determine the weight of the stack on the at least one output tray and for providing a control signal if the determined weight exceeds a predetermined value.

The present invention further relates to a method and a computer program product for controlling a sheet stacking device of a sheet handling system.

2. Background of the Invention

A sheet stacking device of this kind is known for example from JP 2002-326763 A and is used as an output device for sheet handling systems, for example in connection with printers, printing presses and photocopiers.

Sheets of the handled material, which can for example be paper or plastic foil, are stacked onto each other on one or more output trays, also called output bins. The stacked sheets can then be taken from the output trays for further processing.

Known sheet stacking devices usually comprise sensors for determining the stacking height. The determined height is then used to control the stacking device and/or a preceding sheet processing device in order to prevent an overflow of the output stack. Controlling can comprise stopping or postponing the delivery of further sheets to the sheet stacking device until the actual output tray has been emptied, or selecting a different output tray.

Depending on the sheet material used, the weight of an output stack can exceed a maximum weight that is allowed for further processing. This is particularly relevant for output trays that have a high sheet output capacity. A maximum allowed weight for stacks might be due to health and safety regulations or due to limitations imposed by following process stations.

SUMMARY OF THE INVENTION

It is an object of the present invention to provide a sheet stacking device and a method for controlling a sheet stacking device that ensure an output stack of sheets to be in compliance with weight restrictions.

This object is solved by a sheet stacking device, a method for controlling a sheet stacking device and a computer program product for performing a method for controlling a sheet stacking output device according to the present application.

According to the present invention, the sheet stacking device comprises a stack separating mechanism for distinguishing two or more stacks on the same output tray, said stack separating mechanism being controlled by the control unit to limit the weight of the distinguished stacks. Thus, a plurality of stacks, none of which exceeds the weight limit, can be formed on one and the same output tray and can readily be distinguished from one another.

In an advantageous embodiment, the sheet stacking device comprises a weight sensor coupled to the at least one output tray and electrically connected to the control unit for providing an output signal related to the weight of the stack on the at least one output tray to the control unit. The control unit operably determines the weight of the stack using the output signal of the weight sensor. This way, a measured and thus accurate value for the weight of the stack of sheets can be provided to the control unit.

In a further advantageous embodiment of the sheet stacking device, the control unit comprises an input device configured to process information available in the sheet handling system.

The control unit then operably determines the weight of the stack using the process information.

In a further advantageous embodiment, the control unit is set up to consider the following information of received process information: the number of sheets to be processed and/or the weight of a sheet and/or the size of a sheet and the specific weight of the sheet. This way, the weight of an output stack of sheets can be determined by using process information that is usually already available within the sheet handling system.

In a further advantageous embodiment of the sheet stacking device, the control unit comprises a counter for counting the number of sheets in the stack. The weight of the stack is then determined using the process information available in the sheet handling system and the number of sheets in the stack provided by the counter.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
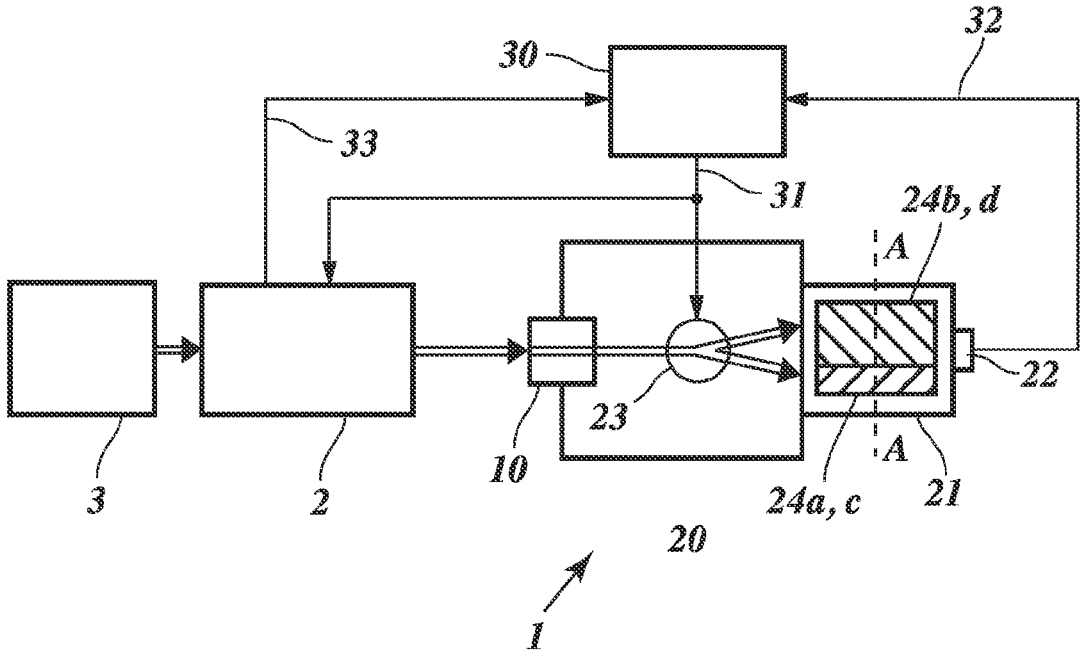
FIG. 1 shows a sheet handling system with a first embodiment of a sheet stacking device in a schematic drawing.

FIG. 1 shows a sheet handling system with a sheet stacking device 1 that is coupled to a sheet processing device 2 which is connected to and fed by a sheet supply 3. The sheet stacking device 1 includes a sheet entrance pathway 10 and an output unit 20 with, in this example, a single output tray 21, equipped with a weight sensor 22. The output unit 20 further includes a stack separating mechanism 23 that is connected to the sheet entrance pathway 10 on the one hand and to the output tray on the other hand, thus allowing stacking sheets on the output tray 21 to form stacks 24*a* and 24*b* that are separated from one another. The sheet stacking device 1 further comprises a control unit 30 that is electrically connected to the stack separating mechanism 23 of the output unit 20 and to the processing device 2 for controlling these entities by a control signal 31. The control unit 30 is further connected to the weight sensor 22 for receiving a weight related output signal 32 provided by the weight sensor 22. In the figure, transport pathways for sheets are indicated by a double-lined arrow. Electrical connections are depicted by single-lined arrows.

In the example shown, the stack separating mechanism 23 allows papers to be stacked onto the output tray 21 with a lateral offset. By stacking a first number of sheets with a first offset (or without any offset) and a second number of sheets with a second offset that differs from the first offset, a first and a second stack 24*a* and 24*b* of sheets are formed. A third stack and a fourth stack 24*c* and 24*d* are then formed in an analogous manner, again using the first and the second offset. The stacks 24 *a-d*, and possibly further stacks, are positioned on top of each other, but can be easily distinguished from each other by the respective offset.

Figure 2:
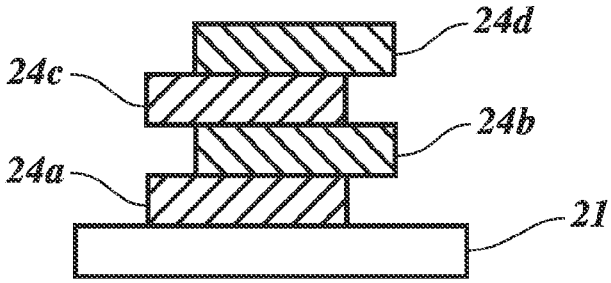
FIG. 2 is a schematic sectional drawing of the output tray of the sheet stacking device of FIG. 1.

FIG. 2 shows a schematic sectional view across the output tray 21 and stacks 24 *a-d* along the line A-A indicated in FIG. 1. The separation of the stacks *a-d* according to the first and second offset is apparent in this view.

It is noted that all means for distinguishing two or more stacks 24 from each other can be used within the frame of the application. Besides the possibility of laterally displaced sheets stacked on one output tray 21 as shown in the embodiment of FIG. 1, a further option would be to insert sheets of a different color or material as stack separators between stacks 24 positioned on top of each other. Also, different output directions could be utilized for distinguishing the stacks 24, for example by putting the stacks 24 on top of each other with the orientation of the sheets changing by 90° degrees from stack to stack.

It will also be noted that the number of output trays is not limited to one.

In the system shown, the processing device 2 could for example be a printer for connection to a computer. Alternatively or additionally, the processing device 2 could be a document photocopier. In such systems, the sheet supply 3 is usually integrated into the device in the form of one or more paper cassettes. Similarly, the sheet stacking device 1 could be an integral part of the system, such that the whole system is integrated into one common housing.

Rather than a compact system as described above, the system shown in FIG. 1 could as well be part of a larger printing press designed for a high throughput. In such a case, the sheet stacking device 1 is usually provided as a separate, individual apparatus that is coupled to the processing device 2, but not integrated into one common housing.

Sheets of paper, plastic foil or made of other material are supplied by the sheet supply 3 and are processed by the processing device 2, for example printed by a printer. The sheets are subsequently transferred to the sheet stacking device 1, which they enter via the sheet entrance pathway 10. In the example shown in FIG. 1, only the one processing device 2 is connected to the sheet stacking device 1. However, in principle, the sheet stacking device 1 could provide more than one sheet entrance pathway 10 and could accordingly be connected to more than one sheet processing device 2 for receiving incoming sheets.

From the sheet entrance pathway 10, the sheets are transported to the stack separating mechanism 23, which can deliver them to the output tray 21, such that the separated stacks 24*a*-24*d* of sheets can be formed on the output tray 21.

The weight sensor 22 is mechanically coupled to the output tray 21, such that a value related to the weight of sheets stacked on each tray is determined. The sensor 22 can either be integrated into the output tray 21 or can be integrated into a mechanical support that carries the output tray 21. Preferably, the measured weight related value represented by the output signal 32 of the weight sensor 22 is at least proportional to the total weight of all the stacks on the output tray 21 or, even more preferred, are already corrected for a tare weight of the output tray 21. Alternatively, the tare weight of the output trays 21 can be taken into account in the course of the further processing of the output signal 32. The output signal 32 is sent to the control unit 30, where it is processed further. The output signal 32 can be transmitted in the form of an analog signal or in the form of digitally coded signals, using an agreed data protocol. The weight sensor 22 could for example be an electro-mechanical system or could be a piezo-electrical system. In an embodiment, wherein the stacks are formed on a moveable platform, the amount of electrical power needed to lower or raise the platform may be used as a measure for the weight of the stacks.

The control unit 30 of the sheet stacking device 1 can be a separate component as shown in the schematic drawing of FIG. 1. Alternatively, it could be integrated into a central control system of the sheet handling system or into a control unit of the sheet processing device 2.

In one embodiment of a method for controlling the sheet stacking device of FIG. 1, the control unit 30 could be provided with a predetermined value that denotes the maximum weight allowed for a stack of sheets on the output tray 21. A maximum allowed weight could for example result from health and safety regulations to protect personnel from carrying too heavy weights. The weight related output value represented by the output signal 32 is converted into the actual weight of a single stack, e.g. 24*d* that is currently being formed on the output tray 21 by subtracting therefrom a stored value that represents the accumulated weight of all previous stacks (24*a*-24*c*). The determined actual weight is then compared to the predetermined value of the maximum weight allowed. If the actual weight exceeds the predetermined maximum weight, a control signal 31 is released from the control unit 30 and provided to the processing device 2 and the stack separating mechanism 23.

On the occurrence of the control signal 31, the stack separating mechanism 23 is switched from one offset position to the other so that subsequent sheets are discharged with a different offset and a new stack is formed. If necessary, the operation of the processing device 2 may be interrupted for the time that is needed for switching.

The current value of the weight related output value is used for updating the accumulated weight, so that the weight of the new stack to be formed can be calculated and monitored.

Additionally, a message could be displayed and/or an acoustic signal could be emitted to inform a user of the system that the maximum weight of the stack (e. g. 24*d*) is reached.

The control signal 31 is preferably a digital signal, using a data protocol that allows encoding of a variety of different commands. It is furthermore advantageous to use a bi-directional data transmission for handshaking and acknowledging data transmission and for returning success and status information.

A possible modification of the embodiment shown in FIG. 1 concerns the determination of the weight of the stacks. In the modified embodiment, the processing device 2 provides process information 33 to the control unit 30. The process information 33 for example comprises the number of sheets in a processed job, for example in one printing job. The process information 33 could further comprise information on the processed media, for example the weight of a single sheet or the size of a sheet and the specific weight of the sheets (weight per area).

By using this information, the control unit 30 determines the weight of the stack or stacks of sheets currently piled on the output tray 21 without measuring it. In addition to the process information 33, stored media information related to the weight or specific weight of standard sheets could be used. Such information could be stored in the form of a database. Additionally, the control unit 30 could keep track of either the number of sheets in the stacks 24 or of the accumulated weight of the sheets in a sheet counter or a weight counter.

A sensor could be coupled to the output tray 21 for determining whether the tray is empty. The information provided by the sensor is used for zeroing the sheet counter and/or the weight counter. If a height sensor for determining the height of a stack and for controlling the height of the stack in order to prevent a stack overflow is present in a sheet stacking device, such a sensor could also be used to determine whether an output tray 21 is empty.

Figure 3:
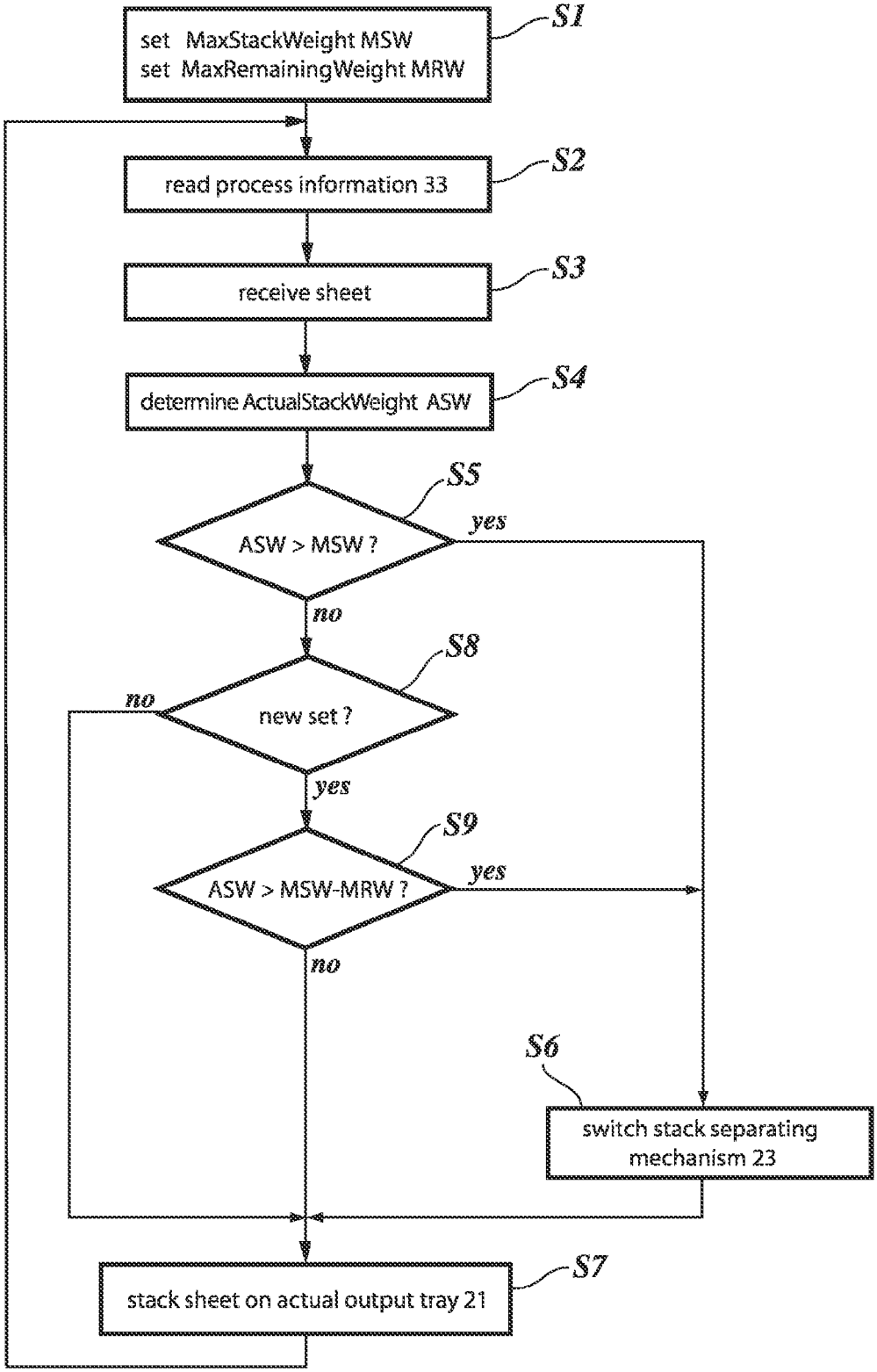
FIG. 3 is a flow chart of an embodiment of a method for controlling a sheet stacking device.

FIG. 3 shows a flow chart of an embodiment of a method for controlling a sheet stacking device of the type described above.

In a first step S1, two values used in the further course of the method are set. The values are referred to as MaxStackWeight (MSW) and as MaxRemainingWeight (MRW). MSW denotes the maximum weight for an output stack. The meaning of MRW will be described later below. If the method is performed by executing a software program on a central processing unit (CPU) as a part of the control unit 30, the two values could be stored in the form of suitable variables. Step S1 could be performed during the production of the sheet stacking device 1 in order to set the two variables with pre-set values. Additionally or alternatively, a graphical user interface (GUI) could be provided that allows the performance of step S1 in the course of operating the sheet stacking device. In such a case, limits for the settings could be implemented, for example to prevent users from setting MSW to a value that exceeds the maximum physical weight-load of one of the output trays 21.

In a step S2, process information 33 is read in by the control unit 30. Often, tasks for the sheet handling system and thus for the sheet stacking device 1 are defined as jobs that could be composed of a number of sets. For example, a printing job could consist of printing a number of copies of a document that comprises several pages. One set would then be one copy of the document, and the job would be the plurality of copies of the requested document. Process information 33 could concern the number of pages in a set and the number of sets. Further information contained in the process information 33 might be related to the weight of a single sheet used for the job. Alternatively or additionally, the specific weight of the sheet material, given in a weight per size and/or the size of the used sheets can be provided for.

In a subsequent step S3, a sheet is received by the sheet stacking device through its sheet entrance pathway 10.

In a next step S4, the weight of the stack that is currently being formed on the output tray 21 is determined. This weight is denoted as ActualStackWeight (ASW).

The value of ASW can be calculate on the basis of the weight related value delivered by the weight sensor 22 or can be updated by the weight of each stacked sheet as taken from or calculated with the aid of the process information 33. Alternatively, a sheet counter could be provided that is incremented with each received sheet. ASW is then given by the product of the counted sheets and the weight of a single sheet. In any case, the value of ASW or the sheet counter is set to zero when a new stack is started.

In a next step S5, a comparison of the ActualStackWeight ASW and the MaximumStackWeight MSW is performed. If ASW is larger than MSW, the method branches to a subsequent step S6, in which the control unit 30 provides the control signal 31 to the stack separating mechanism 23. As a result of receiving the control signal 31, the stack separating mechanism 23 switches to the offset position to be used next.

After having switched to the new offset position, the sheet received in S3 is stacked on the output tray 21 in a step S7. The method then branches back to step S2 for reading in process information 33, which might have been updated in the meantime, in step S2 and for receiving a further sheet in step S3.

If, in step S5, it was determined that ASW has not exceeded MSW, the method continues with a step S8.

In step S8, the process information 33 read in step S2 is used to determine whether the sheet received in step S3 does belong to a new set. If not, the method branches to step S7 for stacking the received sheet on the output tray 21 without changing the offset position. If the sheet received in step S3 does belong to a new set, the method continues with a step S9. In an alternative embodiment, step S8 could check whether the sheet belongs to a new job, rather than a new set.

In step S9, it is determined whether the value of the ActualStackWeight ASW is larger than the difference between MaxStackWeight MSW and MaxRemainingWeight MRW. If this is found to be the case, the method branches to steps S6, in order to switch to a new stack. Thus, at the beginning of a new set, a new stack might be started even if ASW does not exceed MSW. This helps to keep sets together rather than filling a first stack up to the MaximumStackWeight and having to use a new stack for just part of a set. It furthermore assures that a new stack contains at least one complete set.

In an alternative embodiment, the weight of the sheets belonging to one set could be predetermined by using the process information 33 read in the step S2 in case the process information 33 does comprise information on the weight or the specific weight and/or size of the sheets. The pre-calculated value of the weight of a set could additionally be used in step S9 in such a way that a branch to steps S6 is only initiated, if the next set would not completely fit on the actual stack without exceeding MSW.

If the condition for a branch to step S6 has not been fulfilled in step S9, the method continues with step S7 for stacking the received sheet onto the actual stack on the output tray 21.

It is noted that the method as described above can be combined with known procedures for switching output trays based on job conditions and/or related to the height of stacks.

A job related criterion for switching to a new output tray could, for example, be that a new output tray would always be selected when a job or even a set has been finished. A height related criterion would, for example, be that the height of a stack is determined, and that a new output tray would be selected if a predetermined height is exceeded, even if ASW has not reached MSW.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet stacking device for a sheet handling system, comprising:

at least one sheet entrance pathway for receiving incoming sheets;

a sheet output unit with at least one output tray configured to stack the received sheets to form at least one stack on the at least one output tray;

a control unit configured to determine the weight of the stack on the at least one output tray and for providing a control signal if the determined weight exceeds a predetermined value; and a stack separating mechanism configured to distinguish two or more stacks on the same output tray, said stack separating mechanism being controlled by the control unit to limit the weight of the distinguished stacks.

2. The sheet stacking device according to claim 1, further comprising a weight sensor coupled to the at least one output tray and electrically connected to the control unit for providing an output signal related to the weight of the stack on the at least one output tray to the control unit, wherein the control unit operably determines the weight of the stack using the output signal of the weight sensor.

3. The sheet stacking device according to claim 1, wherein:

the control unit comprises an input configured to receive process information provided within the sheet handling system; and the control unit operably determines the weight of the stack using the process information.

4. The sheet stacking device according to claim 3, wherein the control unit is set up to consider the following information contained in the received process information:

the number of sheets to be processed;

the weight of a sheet; and/or the size of a sheet and the weight per unit area of the sheet.

5. The sheet stacking device according to claim 1, wherein the stack separating mechanism is adapted to control an offset with which the sheets are placed on the output tray.

6. The sheet stacking device according to claim 1, wherein the stack separating mechanism is adapted to place a separator sheet on the stack that is already present on the output tray.

7. A method for controlling a sheet stacking device of a sheet handling system, said method comprising the steps of:

receiving incoming sheets;

stacking the received sheets on at least one output tray of the sheet stacking device to form at least one stack;

determining a weight of the stack;

providing a control signal if the weight exceeds a predetermined value; and in response to the control signal, activating a stack separating mechanism for distinguishing a stack to be formed by subsequent sheets from the stack already formed on the output tray.

8. The method according to claim 7, wherein:

the sheet stacking device comprises a weight sensor that provides an output signal related to the weight of the stack; and the weight of the stack is determined using the output signal of the sensor.

9. The method according to claim 7, wherein:

process information available in the sheet handling system is read by the sheet stacking device; and the weight of the stack is determined with the use of the process information.

10. The method according to claim 9, wherein the process information contains:

the number of sheets to be processed;

the weight of a sheet; and/or the size of a sheet and the specific weight of the sheet.

11. The method according to claim 9, wherein:

the sheet stacking device comprises a counter for counting the number of sheets in a stack; and the weight of the stack is determined using the process information and the number of sheets in the stack provided by the counter.

12. The method according to claim 7, wherein:

process information is used to determine a weight that a stack would have if all sheets belonging to a processing task or a defined sub-set of the processing task would be stacked onto this stack in advance; and the control signal is provided if the weight determined in advance exceeds the predetermined value.

13. A computer program product embodied on a non-transitory computer readable medium and comprising coded instructions for controlling a sheet stacking device, wherein a method according to claim 7 is performed when the coded instructions are executed on a central processing unit.

* * * * *